US008169203B1

(12) United States Patent
Vemula

(10) Patent No.: US 8,169,203 B1
(45) Date of Patent: May 1, 2012

(54) LOW DROPOUT REGULATOR

(75) Inventor: Madan Mohan Reddy Vemula, Tempe, AZ (US)

(73) Assignee: NXP B.V., Eindhoven (NL)

( * ) Notice: Subject to any disclaimer, the term of this patent is extended or adjusted under 35 U.S.C. 154(b) by 27 days.

(21) Appl. No.: 12/950,220

(22) Filed: Nov. 19, 2010

(51) Int. Cl.
*G05F 1/40* (2006.01)

(52) U.S. Cl. ..... 323/273

(58) Field of Classification Search ..... 323/273, 323/280, 281; 327/538, 540
See application file for complete search history.

(56) References Cited

U.S. PATENT DOCUMENTS

| | | | | |
|---|---|---|---|---|
| 7,218,083 | B2 * | 5/2007 | Wang et al. | 323/273 |
| 7,323,853 | B2 * | 1/2008 | Tang et al. | 323/280 |
| 7,405,546 | B2 * | 7/2008 | Amrani et al. | 323/273 |
| 2006/0197513 | A1 * | 9/2006 | Tang et al. | 323/273 |
| 2007/0159146 | A1 * | 7/2007 | Mandal | 323/280 |
| 2007/0241730 | A1 | 10/2007 | Dow | |

* cited by examiner

*Primary Examiner* — Adolf Berhane

(57) ABSTRACT

A low-drop out (LDO) regulator circuit is provided having a gate of a pass transistor coupled to an output of an operational transconductance amplifier, the LDO regulator exhibiting a non-dominant pole at an output of the LDO. A dynamic zero-compensation circuit is coupled in parallel to the pass transistor. A compensation control circuit is coupled and configured to adjust a frequency, at which a zero is generated, and cause the generated zero to track with the non-dominant pole.

20 Claims, 4 Drawing Sheets

LOW DROPOUT REGULATOR

One type of voltage regulator, a low drop out (LDO) regulator, is characterized by its low dropout voltage. Dropout voltage is the minimum difference between the input unregulated voltage to the LDO regulator (such a battery or a transformer) and the regulated voltage output from the LDO regulator at max output current conditions. Typically, a linear regulator can only maintain the regulated output voltage while an unregulated voltage supply remains above the dropout voltage. LDO regulators exhibit a significantly small dropout voltage that helps extend the life of the battery because the LDO regulator can continue to provide a regulated voltage until the battery is discharged to a value that is within (typically) 100-500 millivolts of the regulated voltage.

A typical LDO includes a first amplifier stage and a second amplifier stage. The output voltage of the LDO is regulated through a feedback loop. The output is fed back to the first amplifier stage where it is compared to a reference voltage (Vref). First stage amplifier output (amplification of the difference between the feedback voltage and the reference voltage) is used to drive the second amplifier stage. The transfer function of an amplifier is generally not consistent across all frequencies. At certain frequencies, the gain response may be greater or less than other frequencies. When feedback is utilized, the transfer function may exponentially approach infinity or zero at these frequencies, which are respectively referred to as poles and zeroes.

The output signals of all amplifiers exhibit a time delay at pole frequencies when compared to their input signals. This delay causes a phase difference between the amplifier input and output. When the phase difference reaches 360°, the output signal will be in phase with the input signal, reinforcing the input signal and causing the amplifier to oscillate. In many LDO implementations, which feed the output back through an inverting input of the first amplifier stage, the oscillations may be exhibited at 180° because the inverting input adds an additional 180°. The operable phase range in which oscillation does not occur is referred to as the phase margin.

When pole splitting is implemented in a typical PMOS LDO, a dominant pole is located at the output of the first amplification stage and a non-dominate pole is located at the output of the second amplification stage. The dominant pole may be placed well below the unity gain frequency. A non-dominant pole is generally located at or far away from the unity gain frequency.

In order to avoid ringing or oscillations at the LDO output, the LDO is generally configured to exhibit a phase margin at least 45 degrees within a unity gain frequency range. This is generally done by 1) using Miller compensation to introduce a zero in the left-half plane to cancel the non-dominant pole, or 2) moving the non-dominant pole far away from the unity gain frequency in a 2-pole system.

However, the transfer function of an amplifier may vary under different current loads because the non-dominant pole increases in frequency as load current increases. These methods have inherent problems when driving a variable load. The first compensation technique provides a zero and compensates/cancels the non-dominant pole as long as the non-dominant pole location is fixed or it does not vary. Once the non-dominant pole location changes, due to the load, supply, or process, then the fixed zero no longer compensates for the variable non-dominant pole. The second compensation technique often requires large quiescent current consumption to push the non-dominant pole far away from the unity gain frequencies.

In one embodiment, a low-drop out (LDO) regulator circuit is provided. The circuit includes a pass transistor having a gate coupled to an output of an operational transconductance amplifier (OTA), the LDO regulator exhibiting a dominant pole at the output of the OTA and a non-dominant pole at an output of the LDO. A dynamic zero-compensation circuit is coupled in parallel to the pass transistor. A compensation control circuit is coupled and configured to adjust a variable resistor of the dynamic zero-compensation circuit to set a frequency, at which a zero is generated, to track with the non-dominant pole. The compensation control circuit includes a current mirror, a current scaling circuit, and a bias voltage circuit. The current mirror is configured to mirror current flow of the pass transistor. The current scaling circuit is coupled to receive current passing through the pass transistor and pass a fraction of current flow into the current mirror. The bias voltage circuit is coupled to the current scaling circuit and configured to generate a bias voltage proportional to current passed by the current scaling circuit.

In another embodiment, a regulator circuit is provided. The regulator circuit includes a PMOS pass transistor having a gate coupled to an output of a first amplifier stage. The regulator circuit exhibits a non-dominant pole at an output of the regulator circuit. The circuit includes a Miller compensation circuit coupled in parallel to the pass transistor and configured to generate a zero at a frequency location that is adjustable by a bias voltage. The Miller compensation circuit includes a PMOS transistor having a gate coupled to receive the bias voltage. The regulator circuit includes a compensation control circuit having a PMOS transistor configured to mirror current flow of the pass transistor, an NMOS current mirror, and a bias voltage circuit. The PMOS transistor of the compensation control circuit has a gate coupled to the gate of the pass transistor and is configured to mirror current flow of the pass transistor. The NMOS current mirror is coupled to receive current passing through the sense transistor at a first input and is configured to draw an equivalent current at a second input. The bias voltage circuit includes a pair of diode connected PMOS transistors coupled in series between the second input of the NMOS current mirror and a voltage source. The second input of the NMOS current mirror is coupled to provide the bias voltage to the second input of the NMOS current mirror and configured to set the bias voltage to a value proportional to current drawn by the second input of the NMOS current mirror.

In yet another embodiment, a regulator circuit is provided. The regulator circuit includes a PMOS pass transistor having a gate coupled to an output of an operational transconductance amplifier (OTA). The regulator circuit exhibits a non-dominant pole at an output of the regulator circuit. The circuit includes a Miller compensation circuit coupled in parallel to the pass transistor and configured to generate a zero at a frequency location that is adjustable by a bias voltage. The Miller compensation circuit includes a PMOS transistor having a gate coupled to receive the bias voltage. A PMOS sense transistor having a gate coupled to the gate of the pass transistor is configured to mirror current flow of the pass transistor. An NMOS mirror is coupled to receive current passing through the sense transistor at a first input and configured to draw an equivalent current at a second input. The circuit includes a pair of diode connected PMOS transistors coupled in series between the second input of the NMOS current mirror and a voltage source. The second input of the NMOS current mirror is coupled to provide the bias voltage to the Miller compensation circuit. The pair of diode-connected PMOS transistors has dimensions which cause the frequency location of the zero to track with the non-dominant pole within at least a unity gain frequency range of the regulator circuit.

The above discussion is not intended to describe each embodiment or every implementation. The figures and following description also exemplify various embodiments.

Various example embodiments may be more completely understood in consideration of the following detailed description in connection with the accompanying drawings, in which.

Figure 1:
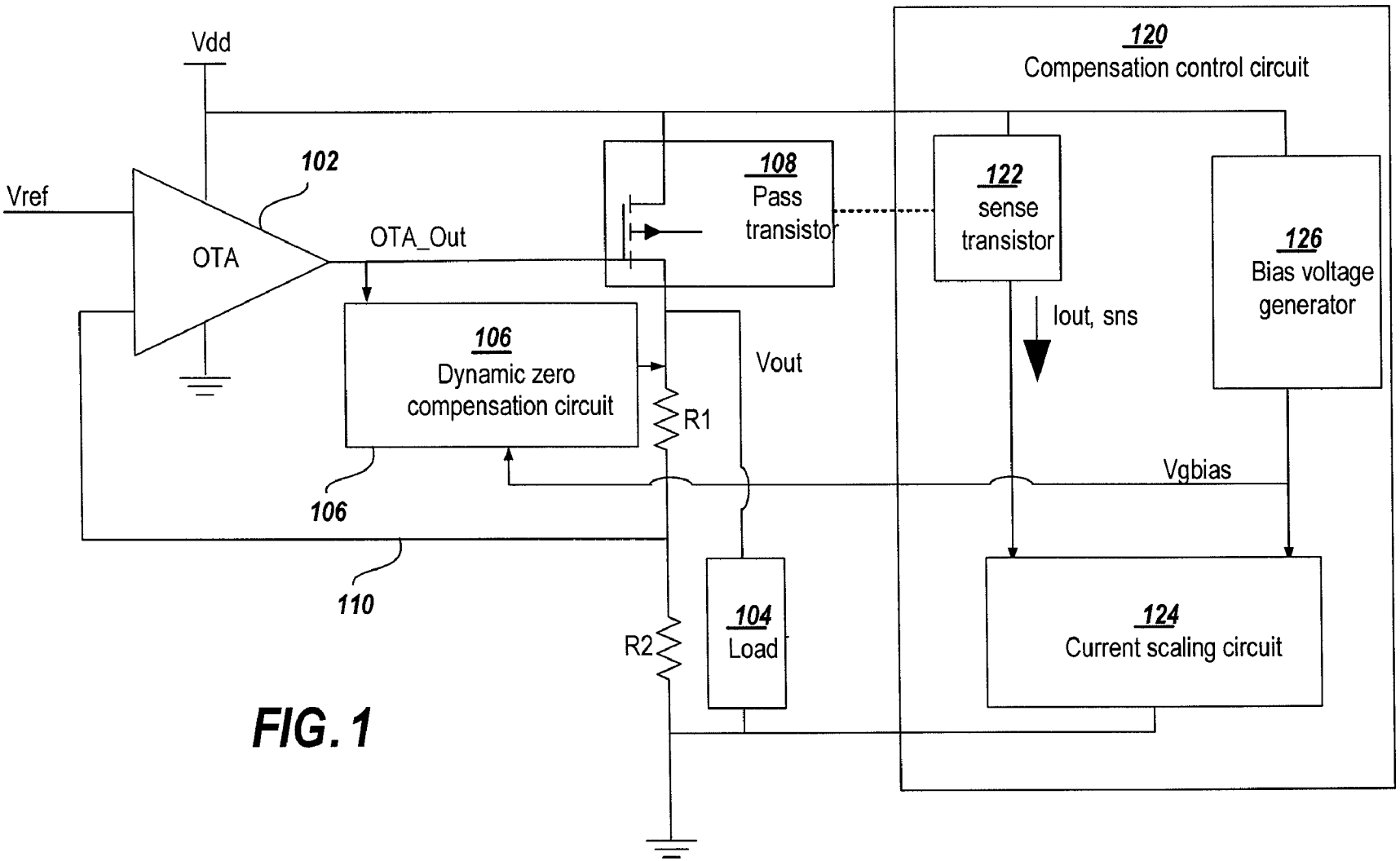
FIG. 1 shows an abstracted circuit diagram of the low-drop out (LDO) regulator circuit.

While the disclosure is amenable to various modifications and alternative forms, examples thereof have been shown by way of example in the drawings and will be described in detail. It should be understood, however, that the intention is not to limit the disclosure to the particular embodiments shown and/or described. On the contrary, the intention is to cover all modifications, equivalents, and alternatives falling within the spirit and scope of the disclosure.

The disclosed embodiments are believed to be applicable to a variety of different types of processes, devices, and arrangements for use with various regulator circuits. While the embodiments are not necessarily so limited, various aspects of the disclosure may be appreciated through a discussion of examples using this context.

One or more example embodiments provide an LDO regulator circuit having a dynamic compensation circuit configured to create a dynamic zero that tracks with a variable non-dominant pole of the circuit. The variable compensation circuit may be implemented using Miller RC (variable R and Fixed C) compensation circuitry with an active PMOS transistor used as the variable resistor. To track with the non-dominant pole, a PMOS gate bias voltage is adjusted to change the on-channel resistance of the PMOS transistor as a function of the load current. One or more embodiments provide an efficient compensation control circuit to determine the load current and generate a proportional bias voltage to drive the gate of the PMOS transistor so that the generated zero tracks with the non-dominant pole.

FIG. 1 shows a block diagram of an example LDO regulator circuit arranged in accordance with one or more embodiments. The LDO includes a first amplification stage, operational transconductance amplifier (OTA) 102 connected in the series-shunt feedback configuration with second amplification stage pass transistor 108 and resistor divider network (R1,R2), which forms a negative feedback system. The negative feedback system stabilizes the output voltage (Vout) and decreases the output impedance by factor of open loop gain of the LDO. OTA 102 reduces the error between an input reference voltage (Vref) and feedback point (110).

PMOS pass transistor 108 is designed to operate in the saturation region and deliver maximum output current across a wide power supply and temperature ranges. Second stage gain (A2) provided by pass transistor 108 is determined by the transconductance of the pass transistor and output impedance at LDO output (Vout). One skilled in the art will recognize that the second stage gain A2 results in pole splitting due to the Miller effect. As a result, the dominant pole is moved away from the unity gain frequency toward the lower frequency by factor of the second stage gain (A2).

Likewise, as the current of load 104 increases, the non-dominant pole location at the LDO output moves toward higher frequencies. To compensate for the non-dominant pole, dynamic zero compensation circuit 106 is coupled in parallel with pass transistor 108 and is configured to form a left-half-plane zero at a frequency that can be adjusted by a control input. In order to compensate for the non-dominant pole, the LDO circuit includes a compensation control circuit 120 to control the placement of the zero to track with the movement of the dominant pole.

As the load current increases, the compensation control circuit 120 senses the load current using sense transistor 122. The sensed current is mirrored and fed to bias voltage generator 126. The bias voltage generator 126 generates a bias voltage to adjust the dynamic zero compensation circuit 106 in proportion to changes in the current sensed by sense transistor 122. In this manner, the generated zero tracks the non-dominant pole located at the LDO output and cancels it.

In one or more embodiments, the compensation control circuit 120 may include a current scaling circuit 124 to reduce power usage of the LDO. The current scaling circuit 124 is configured to receive and scale current passed by sense transistor 122. The current scaling circuit 124 draws a current equivalent to the scaled current from the bias voltage generator 126. In such an implementation, the bias voltage generator is configured to set the bias voltage in proportion to this scaled current. In this manner, power consumption may be reduced.

Figure 2:
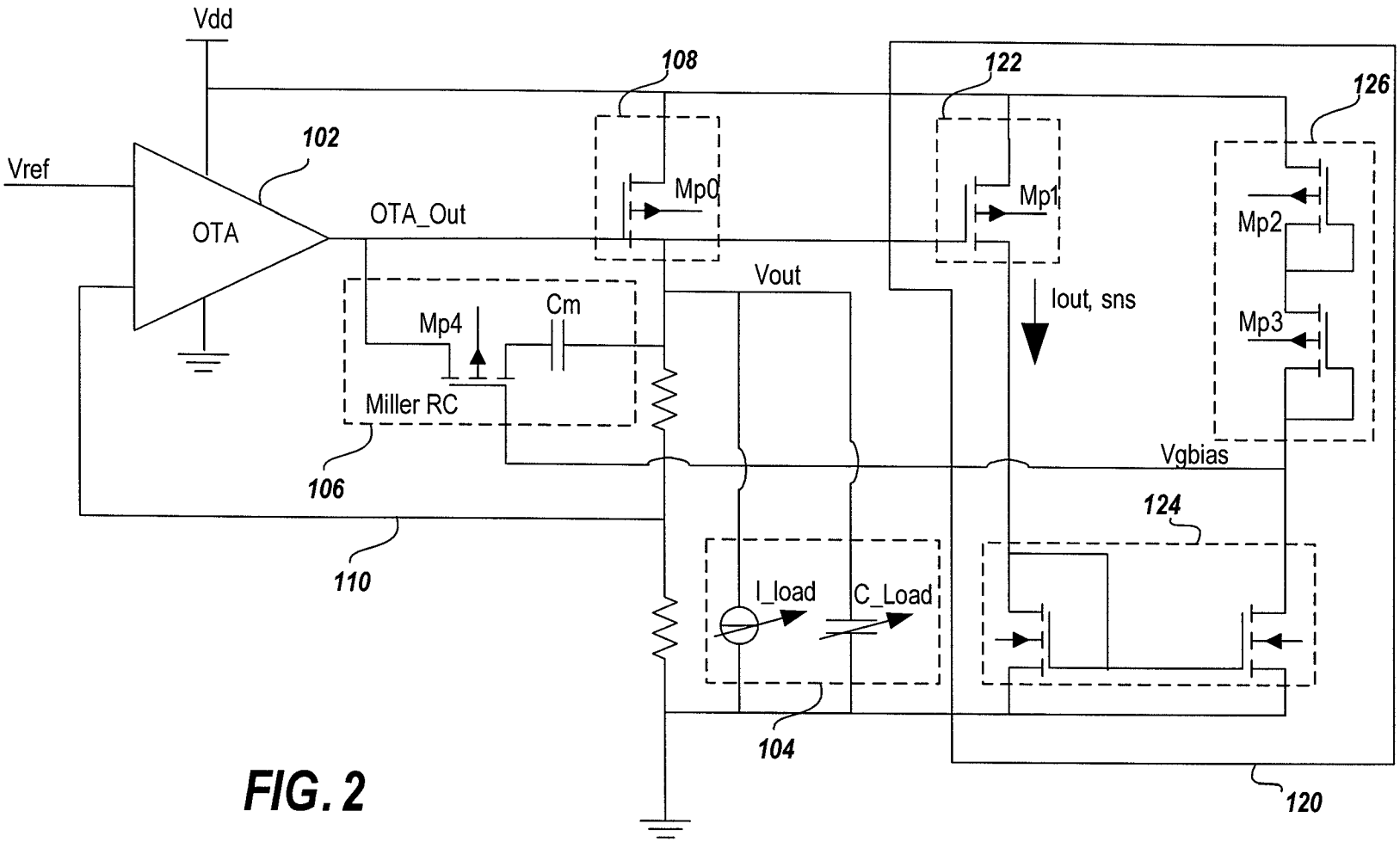
FIG. 2 shows a detailed circuit diagram of the LDO regulator circuit.

FIG. 2 shows an example implementation of the LDO regulator circuit depicted in FIG. 1. The dynamic zero compensation circuit is implemented using a Miller compensation circuit. The Miller compensation circuit includes a PMOS transistor (Mp4) together with a Miller capacitor and is designed to form a left-half-plane zero. PMOS transistor Mp4 has a variable gate source voltage and is designed to operate in a linear region as a variable resistor.

As described above, the load 104 driven by the LDO may exhibit variable current and capacitance. As the load current increases, the compensation control circuit 120 is configured to lower the bias voltage used to gate PMOS transistor Mp4. The lower bias voltage causes the Miller compensation PMOS transistor to become low ohmic, which in turn, causes the zero to move to a higher frequency location. In this manner, the zero due to the Miller compensation tracks the non-dominant pole at the LDO output and cancels it.

The load current passed by PMOS pass transistor 108 is sensed using another PMOS device Mp1 as a sense transistor. The PMOS sense transistor Mp1 is coupled to the same gate source voltage as the pass transistor and has the scaled dimensions with respect to PMOS pass transistor 108. The PMOS sense transistor Mp1 also has the same characteristics as the PMOS pass transistor 108 (Mp0).

In the illustrated implementation, the current scaling circuit 124 is implemented using an NMOS current mirror. Sensed current passed by sense transistor 122 (Mp1) is fed into the NMOS current mirror. The NMOS current mirror acts to both scale and duplicate the sensed current. The overall current scaling is determined by relative dimensions of sense transistor 122 (Mp1), PMOS pass transistor 108 and NMOS transistors of the current scaling circuit 124.

The mirrored current generated by the NMOS current mirror dictates current flow through bias voltage generator circuit 126. In this example, the bias voltage generator is implemented using two diode-connected PMOS coupled in series. The first diode-connected PMOS has a drain coupled to a power supply voltage and a second diode-connected PMOS has a drain coupled to a source of the first diode-connected PMOS. The drain of the lower diode-connected PMOS provides bias voltage to the Miller compensation circuit.

The OTA 102 is designed to have high output impedance at OTA_Out so that the dominant pole of the LDO is located at the output of the OTA 102 and the non-dominant pole is located at the output of the LDO. Other non-dominant poles due to the parasitic capacitances are located outside of the unity gain frequency range, so they do not affect the phase margin.

The dominant pole frequency at the OTA output (OTA_Out) can be expressed as, $$f_{dom} = \frac{1}{2\pi R_{out}(C_{parasitic} + A_{out}C_m)}$$

where $C_{parasitic}$ is the parasitic capacitance at the node OTA_Out in FIGS. 1 and 2, $R_{out}$ is the output impedance of the OTA 102, $C_m$ is the Miller capacitance, and $A_{out}$ is the gain of the second amplification stage (pass transistor 108 (Mp0) & output load 104). The dominant pole may vary by a factor of 10 due to variations in the load current. A typical dominant pole frequency may vary from a few Hz to kHz (30 Hz to 1.2 kHz by design) as the load current increases from 0 to 30 mA The first non-dominant pole frequency at the LDO output (Vout) may be represented as, $$f_{nd1} = \frac{g_{m,Mp0}}{2\pi(C_m + C_{out})} \quad \text{Equation 1}$$

where $f_{nd}$ is the non-dominant pole at the LDO output, $g_{m,Mp0}$ is the transconductance of the pass transistor (Mp0) 108, $C_m$ is the Miller capacitance, and $C_{out}$ is the load capacitance. $G_{m,Mp0}$ is proportional to the square root of the load current ($I_{out}$). Therefore, $f_{nd}$ is proportional to the square root of the load current.

$$f_{nd1} \propto \sqrt{I_{out}} \quad \text{Equation 2}$$

The non-dominant pole varies from MHz to about few hundred MHz depending on the output current ($I_{out}$). For example, in two example implementations $f_{nd1}$=3.3 Mhz/4.6 Mhz, 47.7 Mhz, 61.6 Mhz, 89.7 Mhz, 139 Mhz, 184 Mhz, 214 Mhz @Rload=1M/100 k/10 k/1 k/500/200/100/65Ω & $C_{out}$=30 pF and $f_{nd1}$=2.2 Mhz/3.0 Mhz, 9.6 Mhz, 40 Mhz, 58.8 Mhz, 91.1 Mhz, 121 Mhz, 140 Mhz @Rload=1M/100 k/10 k/1 k/500/200/100/65Ω & $C_{out}$=50 pF The zero generated by the Miller compensation circuit 106 can be represented by, $$f_{zero} = \frac{1}{2\pi(g_{m,Mp0}^{-1} - R_{on,Mp4})C_m} \quad \text{Equation 3}$$

where $f_{zero}$ is the frequency of the generated zero, $g_{m,Mp0}$ is the transconductance of the pass transistor (Mp0) 108, $R_{on,Mp4}$ is the on-resistance of the PMOS transistor (Mp4), and $C_m$ is the Miller capacitance. The LDO is designed that $g_{m,Mp0}^{-1} < R_{on,Mp4}$, so that the Miller zero location is dominated as shown by, $$f_{zero} \propto \frac{1}{(R_{on,Mp4})C_m} \quad \text{Equation 4}$$

Since MP4 has $V_{ds}$ (drain source voltage) close to zero, it operates in linear region and behaves as a resistor. PMOS resistance is given by:

$$R_{on,Mp4} \propto \frac{1}{(V_{gs,Mp4} - V_{th,Mp4})}$$

$$V_{gs,Mp4} = V_{gbias} - V_{src,Mp4}$$

$$R_{on,Mp4} \propto \frac{1}{V_{gbias}}$$

$V_{gbias}$ can be represented written as, $$V_{gbias} \propto \sqrt{I_{outsns}}$$

$$R_{on,Mp4} \propto \frac{1}{\sqrt{I_{outsns}}}$$

where $I_{outsns}$ is the current passed by sense transistor 122 (Mp1). Substituting into the $f_{zero}$ equation above gives, $$f_{zero} \propto \sqrt{I_{outsns}} \quad \text{Equation 5}$$

The above relationship of Equation 2 and Equation 5 illustrates that the zero and the non-dominant pole can be tracked using the sense current.

Use of a PMOS transistor for the variable resistor of the Miller compensation circuit provides a wider dynamic range, thus, allowing the zero to track the non-dominant pole over a larger frequency range using the load current. For example, one skilled in the art will recognize that the gate bias voltage may be generated as follows for one or more implementations. At low output current conditions, $V_{gbias,Mp4}$=Vdd−2$V_{th2,3}$, Source voltage by design=Vdd−$V_{th0}$, and Gate source voltage for the PMOS transistor (Mp4) of the Miller circuit=$V_{th0}$.

where, $V_{th2,3}$ is the threshold voltage for transistors Mp2 & Mp3 of bias generator circuit 126, $V_{gbias,Mp4}$ is the gate voltage for transistor Mp4, $V_{th0}$ is the threshold voltage for pass transistor 108 (Mp0), and Vdd is the LDO supply voltage. Similarly, at high output current conditions, $V_{gbias,Mp4}$=0V, Source voltage by design=Vdd−$V_{th0}$, and Gate source voltage for Mp4=Vdd−$V_{th0}$ The use of a PMOS transistor for the dynamic Miller compensation circuit provides a wide dynamic range from ($V_{th0}$)) to (Vdd−$V_{th0}$) with respect to NMOS implementations. In contrast, a NMOS implementation provides a smaller dynamic range estimated as $$(Vdd/2+V_{th0}-V_{out}) \text{ to } (Vdd+V_{th0}+V_{out})$$

where $V_{out}$=LDO output voltage.

Figure 3:
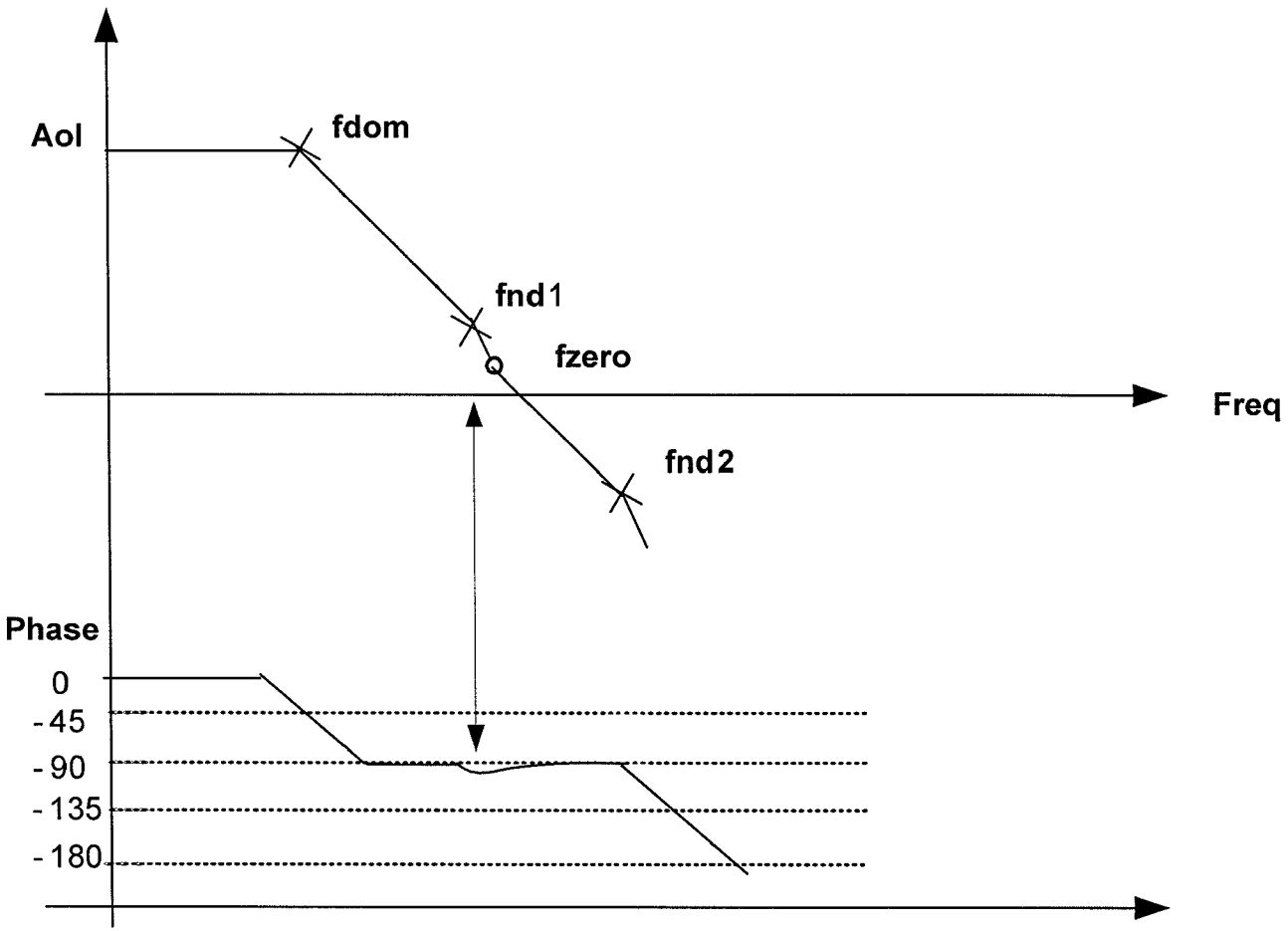
FIG. 3 shows a Bode phase margin plot indicating frequency placement of the dominant pole, non-dominant poles and compensation zero at no load current.
Figure 4:
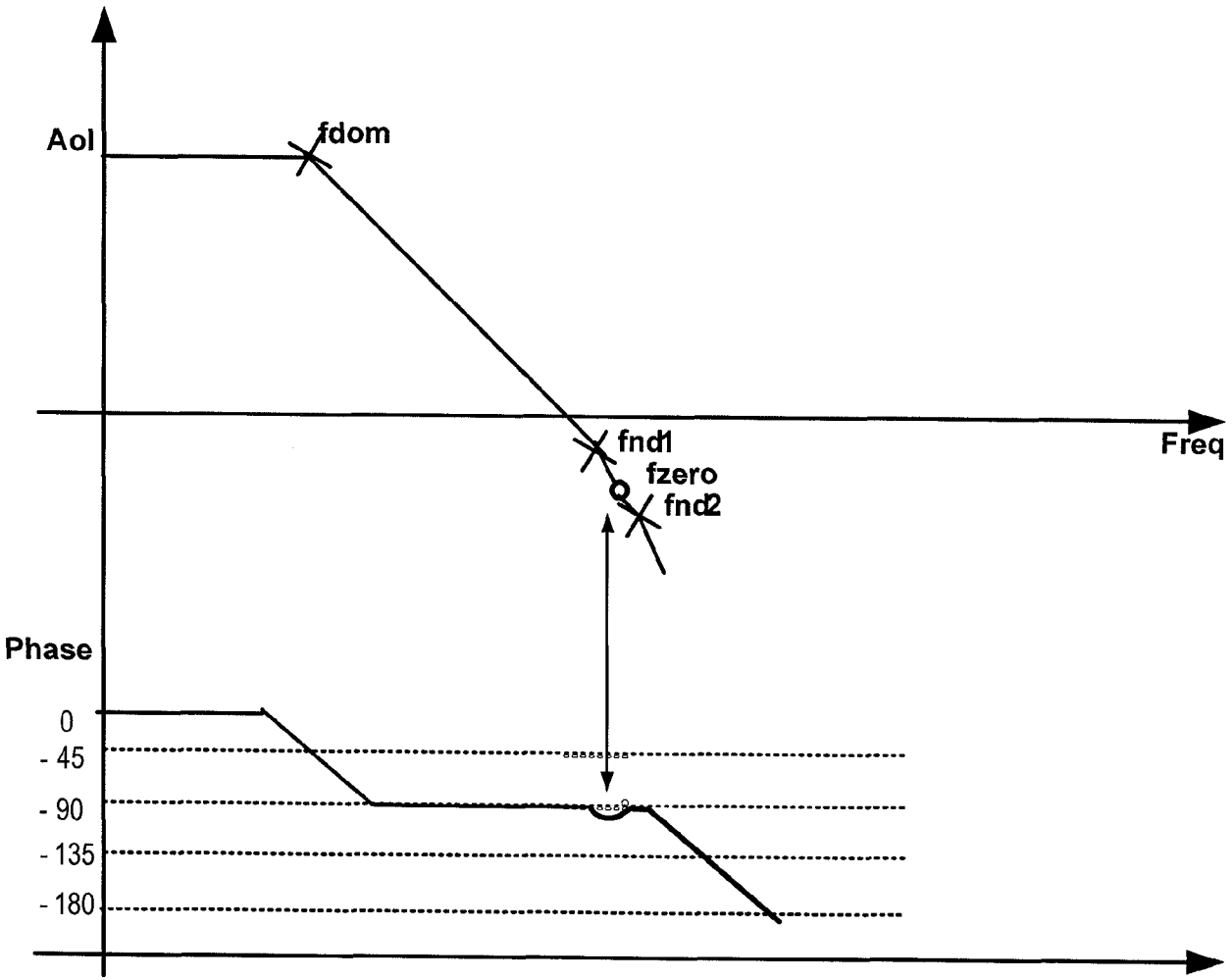
FIG. 4 shows a Bode phase margin plot indicating frequency placement of the dominant pole, non-dominant poles and compensation zero at a high load current.

FIGS. 3 and 4 show Bode phase margin plots indicating the dominant pole, non-dominant poles and compensation zero that are generated at different load currents. A dominant pole ($f_{dom}$) is located at lower frequencies. A first non-dominant pole at the LDO output is shown by $f_{nd1}$. A second non-dominant pole ($f_{nd2}$), resulting from parasitic capacitances, is shown placed at frequencies above the unity gain frequency. As shown in FIG. 3, at lower load currents, $f_{nd1}$ is located near the unity gain frequency. To compensate for this pole the dynamic zero compensation circuit is set to have an initial voltage bias that places the zero nearby to help reduce any decrease in the phase margin. As illustrated in FIG. 4, as the load current increases, the frequency location of the first non-dominant pole (fnd1) increases. To compensate for the first non-dominant pole, the compensation control circuit sets the bias voltage to cause the zero to increase with the first non-dominant pole. As illustrated in FIG. 4, eventually, the non-dominant pole fnd1 will eventually increase outside of the unity gain frequency range, and the zero no longer needs to be tracked proportionally because the pole and zero will not affect the unity gain frequency.

Based upon the above discussion and illustrations, those skilled in the art will readily recognize that various modifications and changes may be made without strictly following the exemplary embodiments and applications illustrated and described herein. For example, different types of regulator circuits may be implemented. Such modifications do not depart from the true spirit and scope of the present disclosure, including that set forth in the following claims.

What is claimed is:

1. A low-drop out (LDO) regulator circuit with zero frequency compensation, comprising:

a pass transistor having a gate coupled to an output of an operational transconductance amplifier (OTA), the LDO regulator exhibiting a dominant pole at the output of the OTA and a non-dominant pole at an output of the LDO;

a dynamic zero-compensation circuit, coupled in parallel to the pass transistor; and a compensation control circuit coupled and configured to adjust a variable resistor of the dynamic zero-compensation circuit, the compensation control circuit including:

a current mirror configured to mirror current flow of the pass transistor;

a current scaling circuit coupled to receive current passing through the pass transistor and pass a fraction of current flow of the current mirror; and a bias voltage circuit coupled to the current scaling circuit and configured to generate a bias voltage proportional to current passed by the current scaling circuit which is proportional to the output current.

2. The LDO regulator of claim 1, wherein the current scaling circuit includes a second current mirror configured to mirror the fraction of the current flow of the current mirror passed by the scaling circuit.

3. The LDO regulator of claim 1, wherein, the variable resistor of the dynamic zero-compensation circuit is a MOSFET transistor having a gate coupled to receive the bias voltage generated by the bias voltage circuit which is a part of the compensation control circuit.

4. The LDO regulator of claim 1, wherein the variable resistor of the dynamic zero compensation circuit is a transistor exhibiting a wider dynamic range characteristic of a PMOS transistor.

5. The LDO regulator of claim 1, wherein the current mirror includes a transistor having a gate coupled to the gate of the pass transistor and exhibiting a dynamic range characteristic of a PMOS transistor.

6. The LDO regulator of claim 1, wherein the bias generator circuit includes:

a first diode-connected MOSFET having a drain coupled to a power supply voltage; and a second diode-connected MOSFET having a drain coupled to a source of the first diode-connected MOSFET.

7. The LDO regulator of claim 6, wherein the first and second diode-connected MOSFETs provide the bias voltage in proportion to the current passed by the current scaling circuit.

8. The LDO regulator of claim 1, wherein the compensation control circuit is configured to provide the bias voltage in proportion to current flow of the pass transistor within a frequency range corresponding to a unity gain of the LDO regulator.

9. The LDO regulator of claim 8, wherein the compensation control circuit is configured to provide the bias voltage in proportion to the current flow of the pass transistor only within a frequency range extending beyond the unity gain of the LDO regulator to configure a gain margin of the LDO regulator.

10. The LDO regulator of claim 1, further including a feedback network coupled between the LDO output and a first input of the OTA.

11. The LDO regulator of claim 1, wherein the feedback network includes a voltage divider coupled to the LDO output and a feedback path coupling an output of the voltage divider to a first input of the OTA.

12. The LDO regulator of claim 1, wherein the dynamic zero-compensation circuit is a Miller compensation circuit including the variable resistor coupled in series with a capacitor.

13. The LDO regulator of claim 1, wherein the compensation control circuit is configured to decrease resistance of the variable resistor as current increases.

14. The LDO regulator of claim 1, wherein the bias voltage is the square root of the current passed by the pass transistor.

15. The LDO regulator of claim 1, wherein the dynamic zero-compensation circuit, creates a zero having a dynamic frequency placement that is proportional to the square root of the output current passed by pass transistor.

16. The LDO regulator of claim 15, wherein the frequency placement of the non-dominant pole is proportional to the square root of the output current passed by pass transistor.

17. The LDO regulator of claim 16, wherein the non-dominant pole and the zero track each other across a unity gain frequency range.

18. The LDO regulator of claim 1, further including an additional dynamic zero-compensation circuit, coupled in parallel to the pass transistor, the additional dynamic zero-compensation circuit configured to generate an additional zero that tracks an additional non-dominant pole.

19. A regulator circuit, comprising:

a PMOS pass transistor having a gate coupled to an output of a first amplifier stage, the regulator circuit exhibiting a non-dominant pole at an output of the regulator circuit;

a Miller compensation circuit coupled in parallel to the pass transistor, the Miller compensation circuit configured to generate a zero at a frequency that is adjustable by a bias voltage;

a compensation control circuit including:

a PMOS sense transistor having a gate coupled to the gate of the pass transistor and configured to mirror current flow of the pass transistor;

an NMOS mirror coupled to receive current passing through the PMOS sense transistor at a first input and configured to draw an equivalent current at a second input; and a bias voltage circuit coupled to the second input of the NMOS current mirror and configured to set the bias voltage to a value proportional to current drawn by the second input of the NMOS current mirror.

20. A regulator circuit, comprising:

a PMOS pass transistor having a gate coupled to an output of an operational transconductance amplifier (OTA), the regulator circuit exhibiting a non-dominant pole at an output of the regulator circuit;

a Miller compensation circuit coupled in parallel to the pass transistor, the Miller compensation circuit configured to generate a zero at a frequency location that is adjustable by a bias voltage, the Miller compensation circuit including a PMOS transistor having a gate coupled to receive the bias voltage;

a PMOS sense transistor having a gate coupled to the gate of the pass transistor is configured to mirror current flow of the pass transistor;

an NMOS mirror coupled to receive current passing through the PMOS sense transistor at a first input and configured to draw an equivalent current at a second input;

a pair of diode connected PMOS transistors coupled in series between the second input of the NMOS current mirror and a voltage source, the second input of the NMOS current mirror coupled to provide the bias voltage to the Miller compensation circuit, the pair of diode-connected PMOS transistors having dimensions which cause the frequency location of the zero to track with the non-dominant pole within at least a unity gain frequency range of the regulator circuit.

* * * * *